US009738071B2

(12) United States Patent
Kato

(10) Patent No.: US 9,738,071 B2
(45) Date of Patent: Aug. 22, 2017

(54) LIQUID DISCHARGE HEAD, LIQUID DISCHARGE DEVICE, AND LIQUID DISCHARGE APPARATUS

(71) Applicant: Masaki Kato, Tokyo (JP)

(72) Inventor: Masaki Kato, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/172,326

(22) Filed: Jun. 3, 2016

(65) Prior Publication Data

US 2017/0001441 A1 Jan. 5, 2017

(30) Foreign Application Priority Data

Jul. 3, 2015 (JP) ..... 2015-134687

(51) Int. Cl.
*B41J 2/14* (2006.01)

(52) U.S. Cl.
CPC ..... *B41J 2/14233* (2013.01); *B41J 2/14201* (2013.01); *B41J 2002/14241* (2013.01); *B41J 2002/14306* (2013.01); *B41J 2002/14419* (2013.01); *B41J 2202/11* (2013.01)

(58) Field of Classification Search
CPC ..... B41J 2/14233; B41J 2/14201; B41J 2002/14241; B41J 2002/14306
See application file for complete search history.

(56) References Cited

U.S. PATENT DOCUMENTS 8,197,048 B2 * 6/2012 Yamanaka ..... B41J 2/055 347/70
2012/0069101 A1 3/2012 Kato et al.
2012/0206540 A1 8/2012 Kato et al.
2012/0206545 A1 8/2012 Kato et al.
2012/0212545 A1 8/2012 Mizukami et al.
2012/0229573 A1 9/2012 Mizukami et al.
2012/0236083 A1 9/2012 Mizukami et al.
(Continued)

FOREIGN PATENT DOCUMENTS

JP 2007-076107 3/2007
JP 2007-301736 11/2007
(Continued)

*Primary Examiner* — Geoffrey Mruk
(74) *Attorney, Agent, or Firm* — Cooper & Dunham LLP

(57) ABSTRACT

A liquid discharge head includes nozzles, a channel plate, a diaphragm member, a supporting substrate, a common liquid chamber forming substrate, a common liquid chamber, a groove, and a fluid restrictor. The supporting substrate is disposed at a side opposite the channel plate, with the diaphragm member interposed in between. The common liquid chamber forming substrate is disposed at a side opposite the diaphragm member, with the supporting substrate interposed in between. The common liquid chamber is communicated with individual liquid chambers. The groove is formed in an in-plane direction of a bonded face of the supporting substrate bonded to the diaphragm member. The fluid restrictor is disposed between the common liquid chamber and the individual liquid chambers. The fluid restrictor is formed between the groove of the supporting substrate and a bonded face of the diaphragm member bonded to the supporting substrate.

12 Claims, 11 Drawing Sheets

(56) References Cited

U.S. PATENT DOCUMENTS

| | | | |
|---|---|---|---|
| 2012/0320131 | A1 | 12/2012 | Kato et al. |
| 2013/0021412 | A1 | 1/2013 | Nishimura et al. |
| 2013/0050354 | A1 | 2/2013 | Kato et al. |
| 2013/0070021 | A1 | 3/2013 | Nishimura et al. |
| 2014/0267499 | A1 | 9/2014 | Kato |
| 2015/0077475 | A1 | 3/2015 | Mizukami et al. |

FOREIGN PATENT DOCUMENTS

| | | |
|---|---|---|
| JP | 2013-129191 | 7/2013 |
| JP | 2013-154485 | 8/2013 |
| JP | 2014-177101 | 9/2014 |
| JP | 2015-006758 | 1/2015 |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

The present application claims priority pursuant to 35 U.S.C. §119(a) from Japanese patent application number 2015-134687, filed on Jul. 3, 2015, the entire disclosure of which is incorporated by reference herein.

BACKGROUND

Technical Field

Aspects of the present invention relate to a liquid discharge head, a liquid discharge device, and a liquid discharge apparatus.

Background Art

In a liquid discharge head including a common liquid chamber and individual liquid chambers, fluid restrictors are disposed between the common liquid chamber and the individual liquid chambers.

For example, one type of liquid discharge head includes a protective substrate bonded to a face of a channel forming substrate on which a pressure generating element is mounted. The protective substrate includes piezoelectric element housing portions, in which pressure generating device are disposed, at one face thereof and through-holes as fluid resistors.

SUMMARY

In an aspect of the present invention, there is provided a liquid discharge head that includes a plurality of nozzles, a channel plate, a diaphragm member, a supporting substrate, a common liquid chamber forming substrate, a common liquid chamber, a groove, and a fluid restrictor. The plurality of nozzles discharges a liquid. The channel plate includes a plurality of individual liquid chambers communicated with the plurality of nozzles. The diaphragm member constitutes a wall of the plurality of individual liquid chambers. The supporting substrate is disposed at a side opposite the channel plate, with the diaphragm member interposed between the supporting substrate and the channel plate. The common liquid chamber forming substrate is disposed at to side apposite the diaphragm member, with the supporting substrate interposed between the common liquid chamber forming substrate and the diaphragm member. The common liquid chamber is communicated with the plurality of individual liquid chambers. The groove is formed in an in-plane direction of a bonded face of the supporting substrate bonded to the diaphragm member. The fluid restrictor is disposed between the common liquid chamber and the plurality of individual liquid chambers. The fluid restrictor is formed between the groove of the supporting substrate and a bonded face of the diaphragm member bonded to the supporting substrate.

In another aspect of the present invention, there is provided a liquid discharge device that includes the liquid discharge head.

In still another aspect of the present invention, there is provided a liquid discharge apparatus that includes the liquid discharge device.

In still yet another aspect of the present invention, there is provided a liquid discharge apparatus that includes the liquid discharge head.

These and other features and advantages of the present invention will become apparent upon consideration of the following description of the preferred embodiments of the present invention when taken in conjunction with the accompanying drawings.

DETAILED DESCRIPTION

Figure 1:
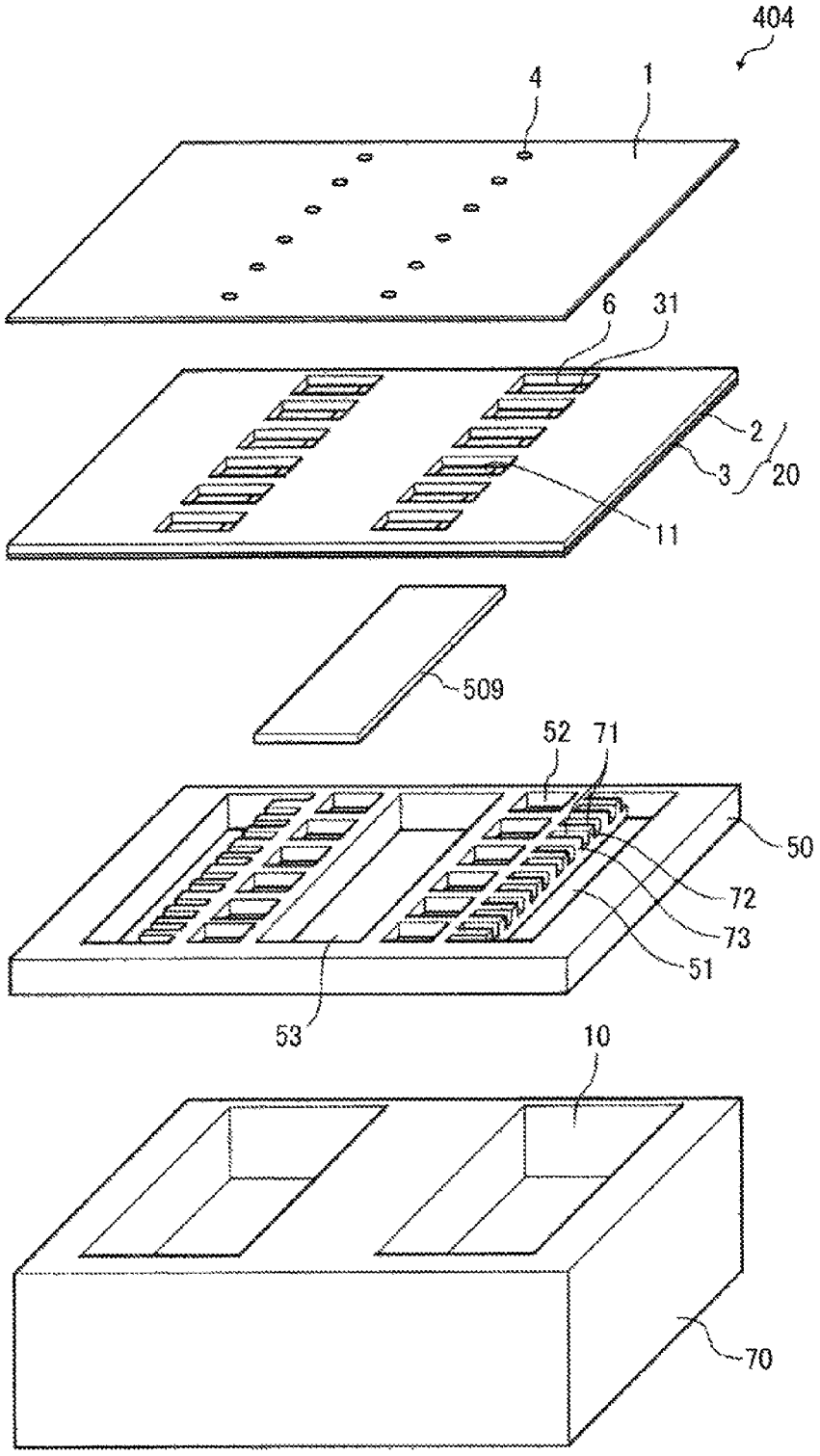
FIG. 1 is an exploded cross-sectional view of a liquid discharge head according to a first embodiment of the present invention.
Figure 2:
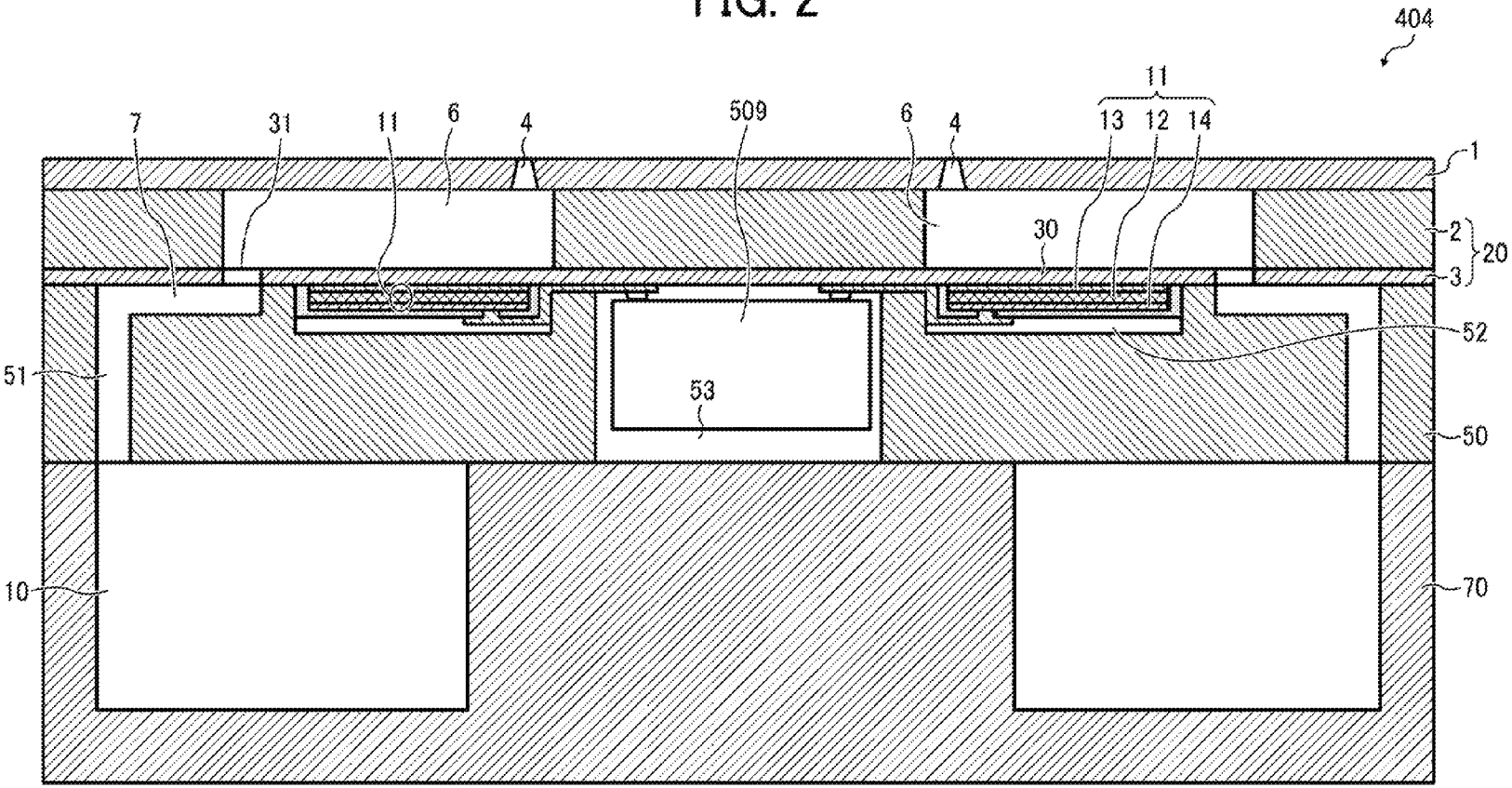
FIG. 2 is a cross-sectional view of the liquid discharge head along a direction perpendicular to a nozzle alignment direction of the liquid discharge head.

Hereinafter, embodiments of the present invention are described with reference to accompanying drawings. A liquid discharge head according to a first embodiment of the present invention is described with reference to FIGS. 1 and 2. FIG. 1 is an exploded cross-sectional view of the liquid discharge head. FIG. 2 is a cross-sectional view of the liquid discharge head along a direction perpendicular to a nozzle alignment direction of the liquid discharge head.

The liquid discharge head 404 includes a nozzle plate 1, a channel plate 2, a diaphragm member 3, piezoelectric elements 11 as pressure generating devices, a supporting substrate 50 (also referred to as protective substrate), a common liquid chamber substrate 70, and a driver integrated circuit (IC) 509.

In the present embodiment, the channel plate 2, the diaphragm member 3, and the piezoelectric elements 11 disposed between the nozzle plate 1 and the supporting substrate 50 as a whole are referred to as an actuator substrate 20. However, the liquid discharge head is not limited to such a case in which, after formation of the actuator substrate 20 as an independent member, the actuator substrate 20 are bonded to the nozzle plate 1 and the supporting substrate 50.

The nozzle plate 1 includes two nozzle arrays each including a plurality of nozzles 4 to discharge liquid.

The channel plate 2, together with the nozzle plate 1 and the diaphragm member 3, forms through-holes as individual liquid chambers 6 communicated with the plurality of nozzles 4. Liquid is supplied from common liquid chambers 10 to the individual liquid chambers 6 through through-boles 31 of the diaphragm member 3, fluid restrictors 7 formed by the diaphragm member 3 and the supporting substrate 50, and through-holes 51 of the supporting substrate 50.

The diaphragm member 3 forms deformable vibration plates (vibrating areas) 30 constituting part of walls of the individual liquid chambers 6.

Each of the piezoelectric elements 11 is disposed integrally with the vibration plate 30 on a surface of the vibration plate 30 opposite the individual liquid chamber 6, so that the vibration plate 30 and the piezoelectric element 11 form a piezoelectric actuator. The piezoelectric element 11 is constructed of a lower electrode 13, a piezoelectric layer 12, and an upper electrode 14 that are sequentially laminated one on another in this order from the side of the vibration plate 30.

In the thus-configured liquid discharge head, an electric voltage is applied from the driver IC 509 to a portion between the upper electrode 14 and the lower electrode 13 of the piezoelectric element 11, so that the piezoelectric layer 12 expands in a direction where the electrodes are laminated one after another, that is, in a direction of electric field, and contracts in a direction parallel to the vibration plate 30. At this time, since the lower electrode 13 is retained by the vibration plate 30, a tensile force is generated at a side of the vibration plate 30 on which the lower electrode 13 is disposed. As a result, the vibration plate 30 is bent toward the individual liquid chamber 6 to pressurize the liquid inside the individual liquid chamber 6, so that liquid droplets are discharged from the nozzle 4.

The supporting substrate 50 includes a recessed portion (vibration chamber) 52 accommodating the piezoelectric element 11 and is bonded and disposed on the diaphragm member 3 of the actuator substrate 20. The supporting substrate 50 and the diaphragm member 3 form the fluid restrictors 7. The supporting substrate 50 includes a driver IC housing portion to house the driver IC 509.

The common liquid chamber substrate 70 is bonded to a side of the supporting substrate 50 opposite the diaphragm member 3. The common liquid chamber substrate 70 and the supporting substrate 50 form the common liquid chambers 10. The supporting substrate 50 constitutes part of as wall of each of the common liquid chambers 10.

Figure 3:
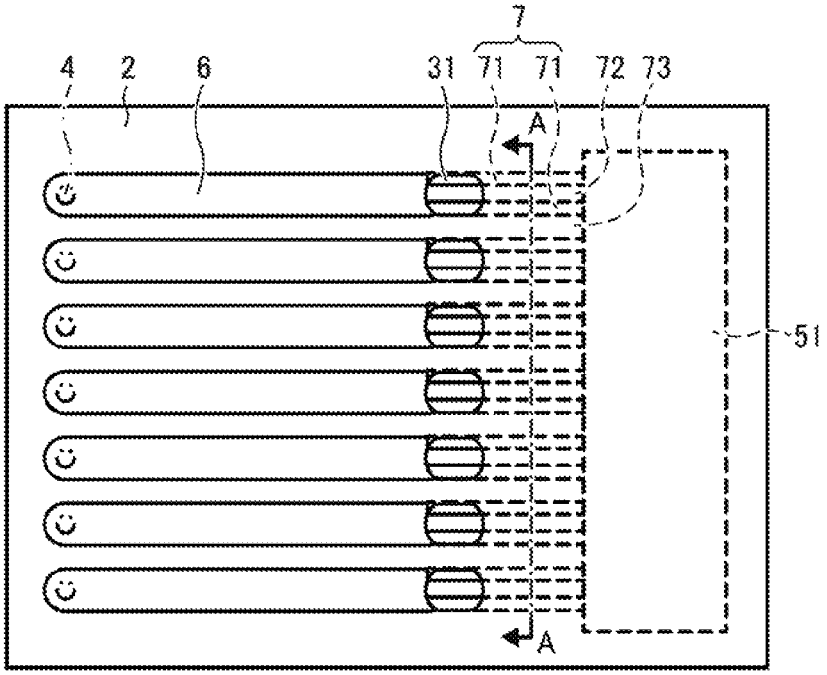
FIG. 3 is a plan view of the liquid discharge head excluding a nozzle plate to explain a fluid restrictor viewed from a channel plate.
Figure 4:
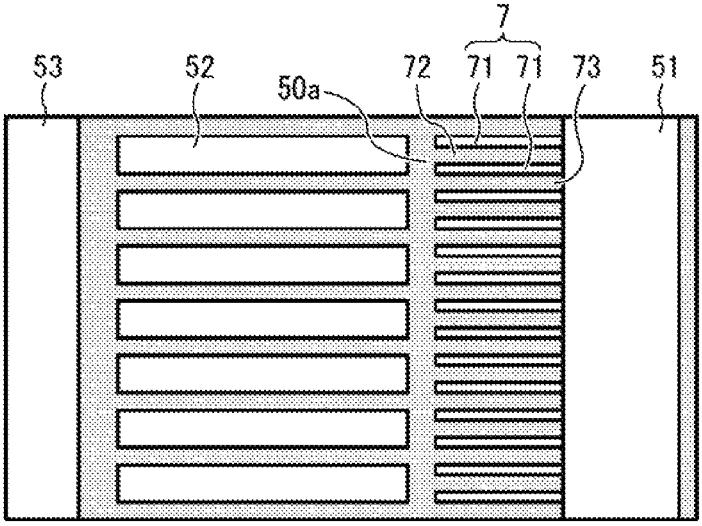
FIG. 4 is a plan view of a supporting substrate of the liquid discharge head viewed from a diaphragm member.
Figure 5:
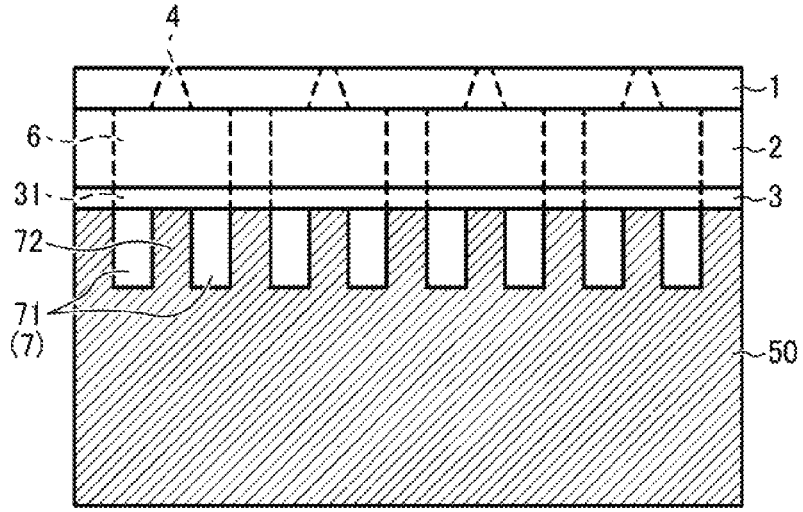
FIG. 5 is a cross-sectional view of a portion of the liquid discharge head along the nozzle alignment direction corresponding to A-A line of FIG. 3.

Next, the fluid restrictor 7 in the liquid discharge head 404 is further described with reference to FIGS. 3 to 5. FIG. 3 is a plan view of the liquid discharge head 404 excluding the nozzle plate 1 viewed from the channel plate 3. FIG. 4 is a plan view of a supporting substrate 50 of the liquid discharge head 404 viewed from the diaphragm member 3. FIG. 5 is a cross-sectional view of a portion of the liquid discharge head 404 along the nozzle alignment direction corresponding to A-A line of FIG. 3.

The supporting substrate 50 includes the through-hole 51 that open to the common liquid chamber 10. In this example, the through-hole 51 extends to open across all the individual liquid chambers 6 in the nozzle alignment direction.

The supporting substrate 50 includes grooves 71 in a face bonded to the diaphragm member 3. In an in-plane direction of the bonded face, each groove 71 extends along a direction perpendicular to the nozzle alignment direction. In the present embodiment, two grooves 71 are disposed corresponding to one individual liquid chamber 6. One end of the groove 71 communicates with the through-hole 51, and the other end of the groove 71 communicates with the through-hole 31 of the diaphragm member 3. Alternatively, the through-hole 31 of the diaphragm member 3 may be formed of a filter.

The fluid restrictors 7 between the common liquid chamber 10 and the individual liquid chambers 6 are formed between the grooves 71 of the supporting substrate 50 and a face of the diaphragm member 3 bonded to the supporting substrate 50.

A partition wall 72 between two adjacent grooves 71 and a partition wall 73 between two individual liquid chambers 6 are connected to other partition walls 72 and 73 through portions 50*a* of the supporting substrate 50.

As described above, since the fluid restrictor 7 is formed by the grooves 71 formed in the in-plane direction of the supporting substrate 50, the fluid resistance of the fluid restrictor 7 can be defined by a length and an opening cross-sectional area of the grooves 71, thus reducing constraints in forming the fluid restrictor 7.

Specifically, the fluid restrictor 7 disposed between the common liquid chamber 10 and the individual liquid chamber 6 prevents a pressure for performing liquid discharge from escaping to the common liquid chamber 10, and allows the liquid inside the individual liquid chamber 6 to be effectively pressurized. Specifically, the fluid resistance of the fluid restrictor 7 is increased to restrict the flow amount of liquid.

Herein, where the flow amount of liquid inside the channel is Q when the pressure P is applied to one side of the channel, the fluid resistance R is represented by the following formula: $R=P/Q$ [$Pa*s/m^3$] The fluid resistance of the fluid restrictor 7 damps the vibration generated inside the individual liquid chamber 6 by the pressure. Accordingly, the damping of the residual pressure generated after a liquid discharge can be accelerated, thereby reducing the time required to the next liquid discharge. That is, a discharge cycle can be reduced, thereby increasing the drive frequency.

The fluid resistance is proportional to the viscosity and, if the liquid viscosity decreases, the resistance decreases. Namely, when the liquid with a low viscosity is discharged with the high drive frequency, the dimension of the channel is adjusted in order to restrict the residual vibration and the fluid resistance necessary for the damping should be maintained. Thus, when the low viscosity liquid, is discharged, reducing a cross-sectional area of the channel of the fluid restrictor or lengthening the channel is preferable.

By contrast, when discharging a high viscosity liquid, as the fluid resistance increases, the liquid supply amount from the common liquid chamber to the individual liquid chambers should be carefully handled. For example, although the volume of the liquid corresponding to the discharged amount need be supplied from the common liquid chamber, when the fluid resistance is high due to the high viscosity, the supply of the liquid is not enough and the pressure inside the individual liquid chamber turns to be negative pressure.

If the pressure inside the individual liquid chamber becomes negative pressure excessively, an enough discharge pressure cannot be obtained, so that the discharge droplet speed decreases and discharged droplet amount reduces, thereby decreasing the discharge property.

If the negative pressure of the individual liquid chamber further increases, a meniscus being an interface between the liquid in the nozzle and an external air is broken, and the external air is introduced and air bubbles are mixed into the liquid in the nozzle. In this case, because volume elasticity of the air bubbles is very low, the pressure of the liquid inside the individual liquid chamber does not increase, thereby causing discharging failure (including discharging disabled). In particular, discharge is performed at a shorter drive cycle (i.e., high frequency), the individual liquid chamber suffers from an excess negative pressure, and the discharge property is adversely affected.

Accordingly, from the viscosity of the liquid to be discharged and necessary drive cycle or frequency, the dimension of the channel of the fluid restrictor should be adjusted to obtain a proper fluid resistance.

Thus, the channel should be properly designed to adjust the fluid resistance and obtain a desired discharging property.

Herein, the properties that should be made appropriate include inertance in addition to the fluid resistance. The inertance is an amount representing inertia of the fluid member and difficulty of changing the flow volume. The inertance Ma of the channel is defined by $Ma=M/S^2$ [$kg/m^4$], wherein M means the fluid member inside the channel, that is, mass of the liquid, and S means a cross-sectional area of the flow channel. Specifically, when the cross-sectional area of the flow channel increases, the inertance decreases. When the mass of the liquid inside the channel reduces, that is, the density of the liquid is constant and the volume of the flow channel reduces, the inertance can be decreased.

Further, the inertance can be decreased by narrowing the cross-sectional area of the flow channel and shortening the length of the flow channel. As the inertance decreases, responsiveness of the flow volume relative to the pressure can be improved.

When discharging is performed continuously due to the continuous drive of the piezoelectric element, the liquid flows from the common liquid chamber 10 to the nozzle 4.

Herein, if the inertance is satisfactorily low, the response to the flow volume change in the continued discharging is satisfactorily fast, so that the discharging can be performed stably even though the discharging cycle is short and the drive frequency is high. On the other hand, when the inertance is high, the response to the flow volume is not good due to inertia of the liquid, and the meniscus is pushed out toward the discharge surface due to the inertia of the liquid. As a result, because the position of the meniscus is different between a case with a shorter discharging cycle and higher drive frequency and a case with a longer discharging cycle and lower drive frequency, the discharging property is different. Specifically, the discharging property greatly changes due to the fluctuation of the frequency.

Further, the resonance cycle, or Helmholtz cycle, of the individual liquid chamber 6 is determined by the fluid resistance of the fluid restrictor and the inertance.

As described above, the shape of the channel of the fluid restrictor 7 affects the fluid resistance and inertance, and, to make the fluid resistance a satisfactorily high value within a range not to cause an excess negative pressure and to reduce the inertance, a thin and short channel need be disposed.

In this case, the preparation of the shape of the channel should be performed very finely. Thus, when dimensional variation occurs in the further thinner and shorter channel, the dimensional variation further adversely affects, and as a result, the discharging property varies greatly.

The groove serves as the fluid restrictor, thereby reducing adverse effects due to process errors.

In addition, the long channel baying a large cross-sectional area produces a large inertance, thereby worsening the frequency property of the discharging property. Accordingly, in the present embodiment, the fluid restrictor is formed of the plurality of grooves for a single individual liquid chamber, thereby restricting a decrease in the frequency property.

Figure 6:
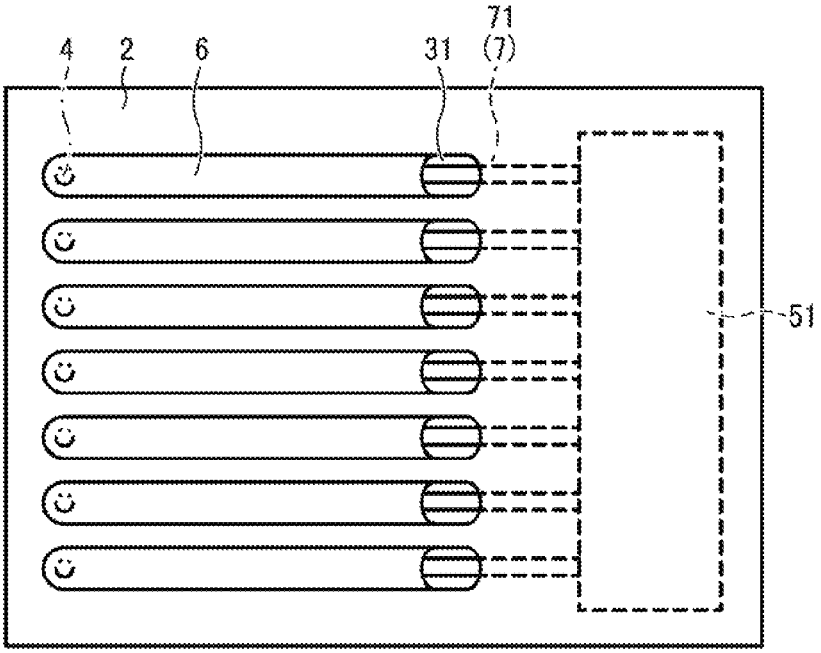
FIG. 6 is a plan view of the liquid discharge head excluding the nozzle plate viewed from the channel plate according to a second embodiment of the present invention.

Next, referring to FIG. 6, a liquid discharge head according to the second embodiment of the present invention is described. FIG. 6 is a plan view of the liquid discharge head excluding the nozzle plate viewed from the channel plate.

In the present embodiment, one groove 71 forms the fluid restrictor 7 of the supporting substrate 50.

Even with one groove 71, constraints in defining the fluid restrictor can be reduced.

Figure 7:
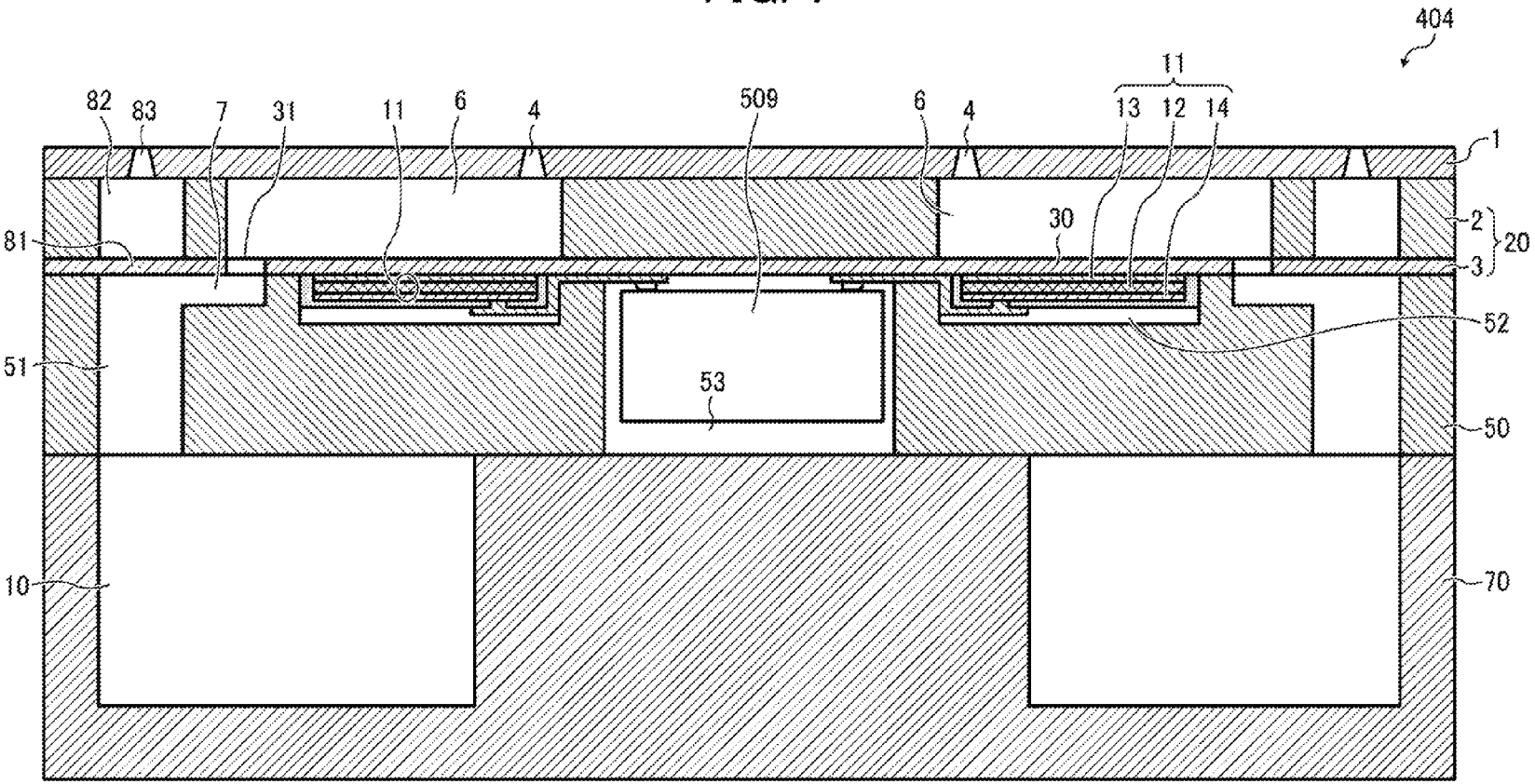
FIG. 7 is a cross-sectional view of the liquid discharge head along the direction perpendicular to the nozzle alignment direction according to a third embodiment of the present invention.
Figure 8:
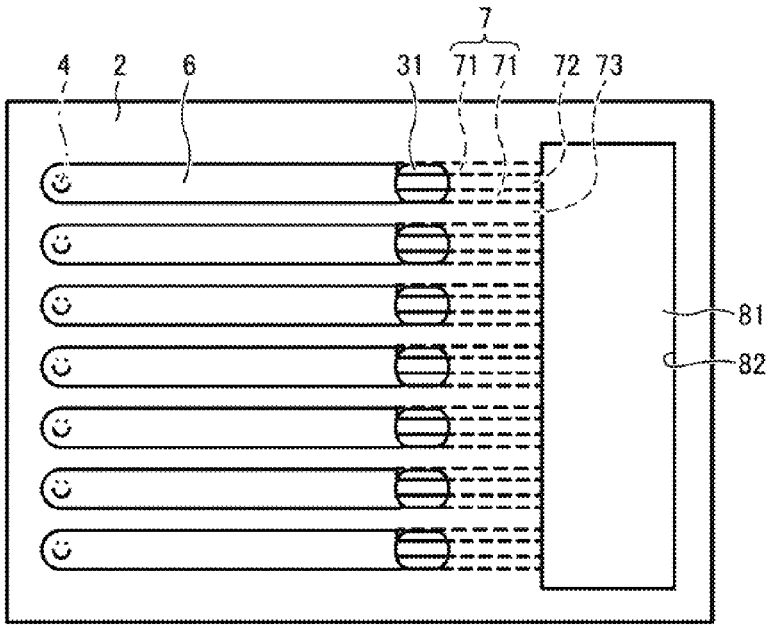
FIG. 8 is a plan view of the liquid discharge head of FIG. 7 excluding the nozzle plate viewed from the channel plate.

Next, a liquid discharge head according to a third embodiment of the present invention is described with reference to FIGS. 7 and 8. FIG. 7 is a cross-sectional view of the liquid discharge head in a direction perpendicular to the nozzle alignment direction, and FIG. 8 is a plan view of the liquid discharge head excluding the nozzle plate viewed from the channel plate.

In the present embodiment, the diaphragm member 3 opposite the through-hole 51 of the supporting substrate 50 forms a deformable damper portion 81, and the channel plate 2 includes as damper chamber 82 disposed at a side opposite the through-hole 51 with the damper portion 81 sandwiched in between.

The damper chamber 82 is communicated with an external air via an open channel or a dummy nozzle 83 disposed on the nozzle plate 1.

With this configuration, fluctuations of the pressure transmitted to the common liquid chamber 10 can be reduced.

Specifically, as described above, the grooves damper 1 formed inside the supporting substrate 50 serve as the fluid restrictor 7, no opening is needed to the diaphragm member 3 at a portion opposite the through-hole 51 of the supporting substrate 50, and the damper portion can be disposed.

In the present embodiment, the damper chamber 82 communicates with the external air via the nozzle plate 1, and alternatively, by forming the groove as a channel (or a flow channel) inside the channel plate 2, the damper chamber 82 can communicate with the external air.

Figure 9:
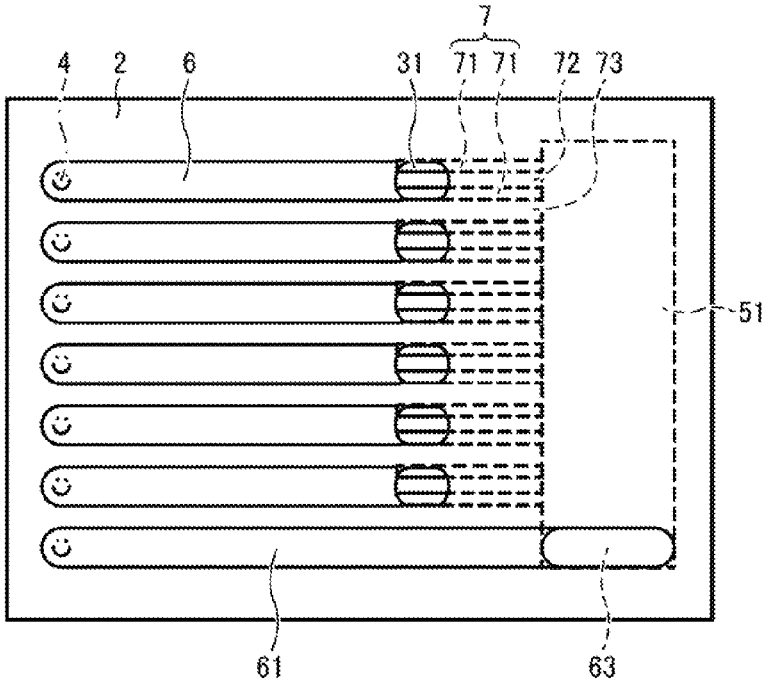
FIG. 9 is a plan view of the liquid discharge head excluding the nozzle plate viewed from the channel plate according to a fourth embodiment of the present invention.

Next, a liquid discharge head according to a fourth embodiment of the present invention is described with reference to FIG. 9. FIG. 9 is a plan view of the liquid discharge head excluding the nozzle plate viewed from the channel plate.

In the fourth embodiment, a dummy individual liquid chamber 61 is disposed at an end in a direction in which the individual liquid chambers 6 are aligned. The dummy individual liquid chamber 61 communicates with the through-hole 51 of the supporting substrate 50 via a through-hole 63 of the diaphragm member 3. The fluid restrictor is not disposed in as supply path of the liquid to the dummy individual liquid chamber 61.

Provision of the dummy individual liquid chamber 61 may improve air bubble discharging efficiency.

Figure 10:
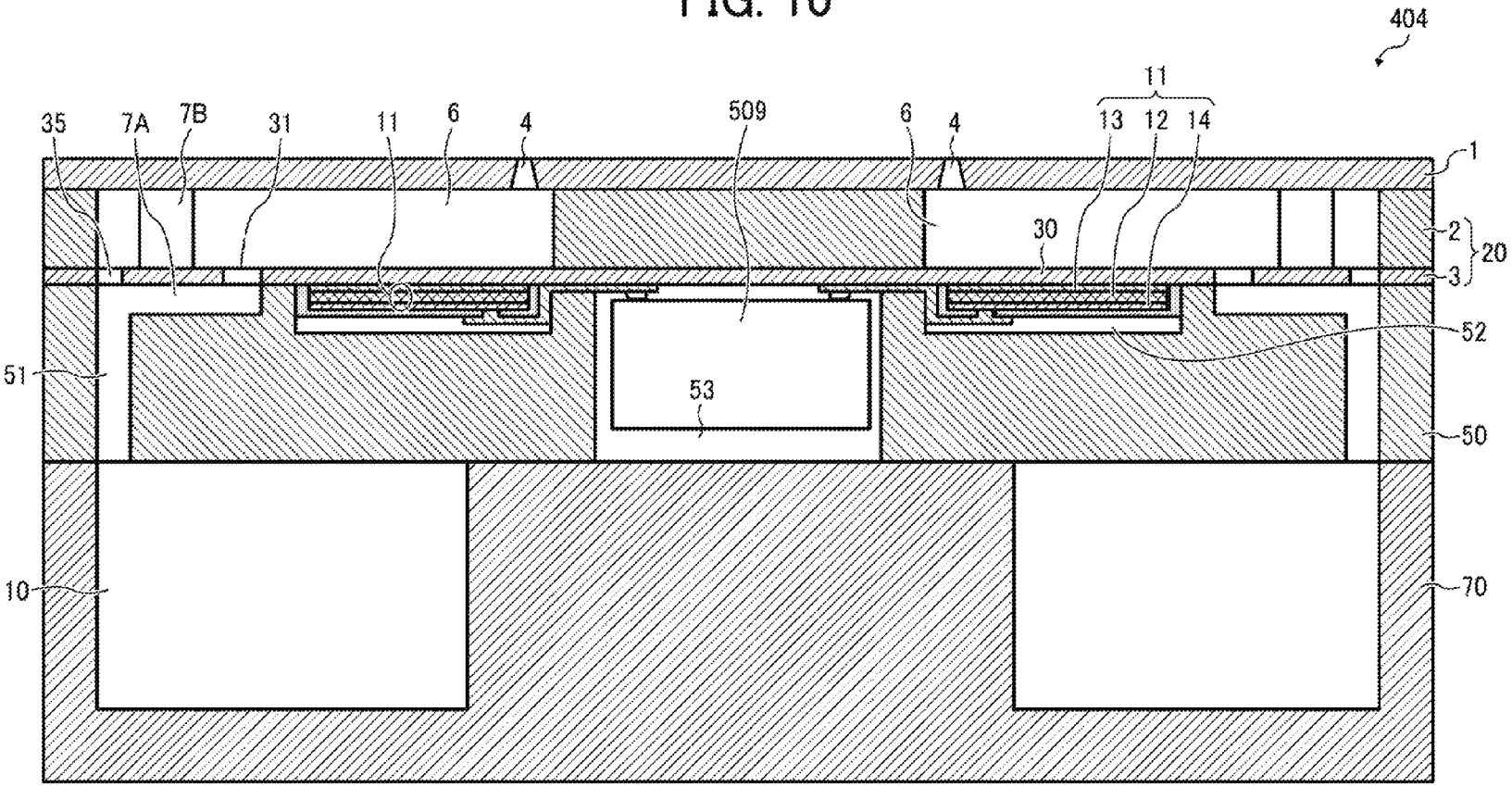
FIG. 10 is a cross-sectional view of the liquid discharge bead along the direction perpendicular to the nozzle alignment direction according to a fifth embodiment of the present invention.
Figure 11:
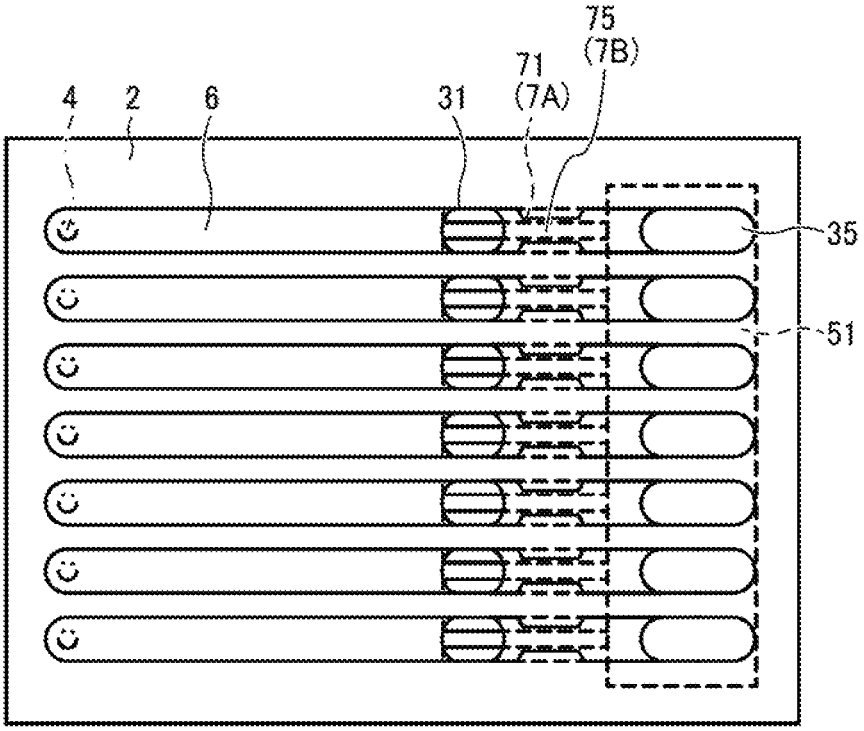
FIG. 11 is a plan view of the liquid discharge head viewed from the channel plate excluding the nozzle plate.

Next, a liquid discharge head according to a fifth embodiment of the present invention is described with reference to FIGS. 10 and 11. FIG. 10 is a cross-sectional view of the liquid discharge head in a direction perpendicular to the nozzle alignment direction, and FIG. 11 is a plan view of the liquid discharge head excluding the nozzle plate viewed from the channel plate.

In the present embodiment, similarly to the second embodiment, one groove 71 is formed on a bonded face of the holding board 50 bonded to the diaphragm member 3 to form a first fluid restrictor 7A.

On the other hand, a through-hole 35 to directly communicate with the through-hole 51 of the supporting substrate 50 is formed on the diaphragm member 3, and a second fluid restrictor 713 is formed of a groove 75 formed of the channel plate 2 between the through-hole 35 and the individual liquid chamber 6.

With this structure, freeness of laying out the fluid restrictor can be improved.

Even in this case, two fluid restrictors 7 are employed to design the channel to reduce the inertance, so that a highly stable and reliable head can be obtained suppressing fluctuations of the discharging speed and the discharged droplet amount due to discharging cycle.

Then, one groove 71 of the supporting substrate 50 is disposed at a side opposite the fluid restrictor 713 of the channel plate 2, thus maintaining the strength of a partition wall 72.

Next, examples of components of the liquid discharge head are described below.

A plurality of nozzles 4 that discharges liquid droplets is disposed on the nozzle plate 1. Exemplary materials for the nozzle plate 1 include, for example, metals or alloys such as SUS, nickel, and the like, nonorganic materials such as silicon, ceramics, and the like, and resins such as polyimide.

The channel plate 2 is formed of a silicon substrate, in which grooves and concave portions to be the individual liquid chamber 6 are formed by etching.

Materials for the diaphragm member 3 may include silicon, nitride, oxide, carbonate, and a laminated film of the above products. The laminated film of $Si_3N_4$ and $SiO_2$ may be used.

The piezoelectric layer 12 employs, in general, lead zirconium titanate and barium titanate. The lower electrode 13 and the upper electrode 14 are made of mono layer film or laminated film of any metals, alloys, and conductive alloys, including Pt, Ir, Ir oxide, Pd, Pd oxide, and the like. In addition, an adherence layer formed of Ti, Ta, W, Cr, and the like, can be disposed between the diaphragm member 3 and the lower electrode 13.

The supporting substrate 50 secures rigidity of the channel plate 2 and is bonded to a side of the actuator substrate 20 opposite the nozzle plate 1. Exemplary materials for the supporting substrate 50 include ceramics such as glass, silicon, $SiO_2$, $ZrO_2$, and $Al_2O_3$.

Figure 12:
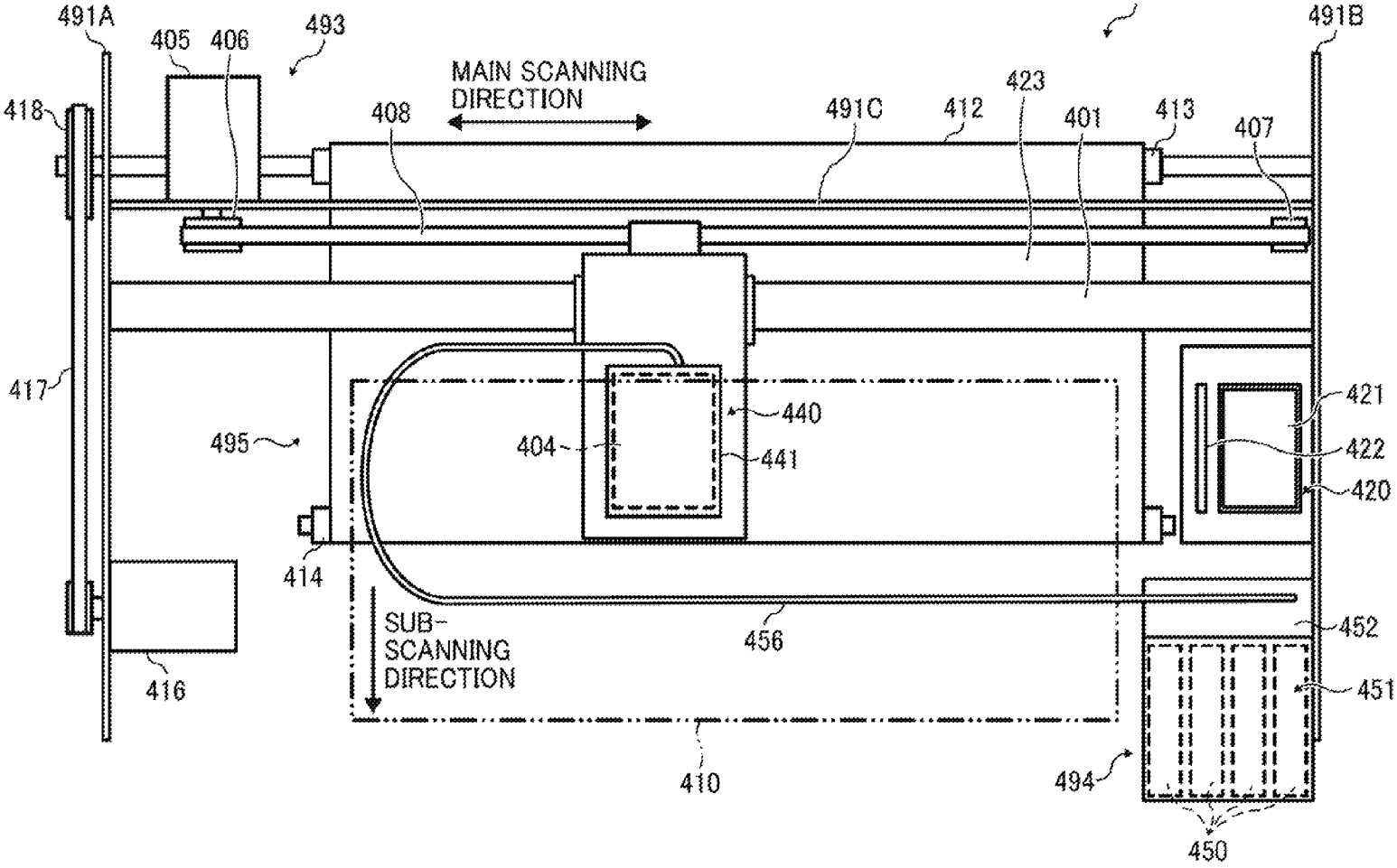
FIG. 12 is a plan view of a portion of a liquid discharge apparatus according to an embodiment of the present invention.
Figure 13:
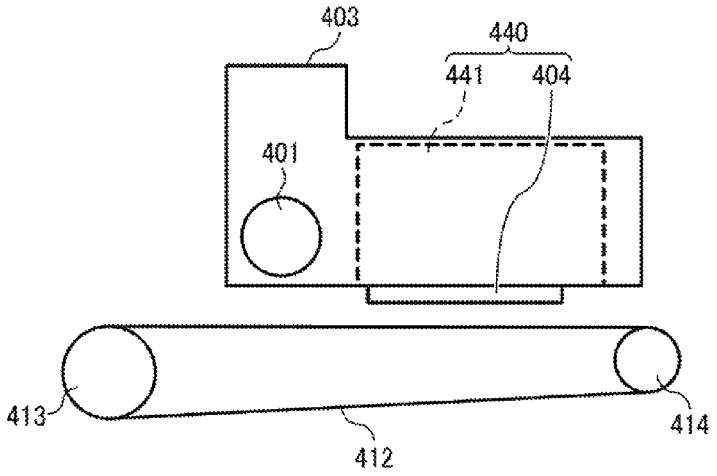
FIG. 13 is a side view of the liquid discharge apparatus of FIG. 12.

Next, a liquid discharge apparatus according to an embodiment of the present invention is described with reference to FIGS. 12 and 13. FIG. 12 is a plan view of a portion of the liquid discharge apparatus, and FIG. 13 is an explanatory side view of the same.

A liquid discharge apparatus 100 according to the present embodiment is a serial-type apparatus so that the carriage 403 reciprocally moves in the main scanning direction by a main scan moving unit 493. The main scan moving unit 493 includes a guide 401, a main scan motor 405, a timing belt 408, and the like. The guide 401 is held on right and left side plates 491A, 491B and supports the carriage 403 to be movable. The main scan motor 405 moves the carriage 403 reciprocally in a main scanning direction via a timing belt 408 stretched between a driving pulley 406 and a driven pulley 407.

A liquid discharge head 404 and a head tank 441 integrally form a liquid discharge device 440 that is mounted on the carriage 403. The liquid discharge head 404 of the liquid discharge device 440 discharges ink droplets of each color of yellow (Y), cyan (C), magenta (M), and black (K). The liquid discharge head 404 includes nozzle arrays formed of a plurality of nozzles 11 arranged in a sub-scanning direction perpendicular to the main scanning direction, with the discharging head oriented downward.

The liquid stored outside the liquid discharge head 404 is supplied to the liquid discharge head 404 via a supply unit 494 that supplies the liquid from a liquid cartridge 450 to the head tank 441.

The supply unit 494 includes a cartridge holder 451 to mount a liquid cartridge 450 thereon, a tube 456, and a liquid feed unit 452 including a feed pump. The liquid cartridge 450 is detachably attached to the cartridge holder 451. The liquid is supplied to the head tank 441 by the liquid feed unit 452 via the tube 456 from the liquid cartridge 450.

The present apparatus includes a conveying unit 495 to convey a sheet 410. The conveying unit 495 includes a conveyance belt 412, and a sub-scan motor 416 to drive the conveyance belt 412.

The conveyance belt 412 electrostatically attracts the sheet 410 and conveys it at a position facing the liquid discharge head 404. The conveyance belt 412 is an endless belt and is stretched between a conveyance roller 413 and a tension roller 414. The sheet 410 is attracted to the conveyance belt 412 due to an electrostatic force Or by air aspiration.

The conveyance belt 412 is caused to rotate in the sub-scanning direction driven by a rotation of the conveyance roller 413 via a timing belt 417 and to timing pulley 418 driven by the sub-scan motor 416.

Further, a maintenance unit 420 to maintain the liquid discharge head 404 in good condition is disposed on the side of the conveyance belt 412 at one side in the main scanning direction of the carriage 403.

The maintenance unit 420 includes, for example, a cap member 421 to cap a nozzle face (i.e., a surface on which the nozzle is formed) of the liquid discharge head 404; a wiper 422 to clean the nozzle face, and the like.

The main scan moving unit 493, the supply unit 494, the maintenance unit 420, and the conveying unit 495 are disposed to a housing that includes side plates 491A, 491B, and a rear plate 491C.

In the thus-configured liquid discharge apparatus, a sheet 410 is conveyed on and attracted, to the conveyance belt 412 and is conveyed in the sub-scanning direction by the cyclic rotation of the conveyance belt 412.

Then, the liquid discharge heads 404 are driven in response to image signals while the carriage 403 moving in the main scanning direction, and a liquid is discharged to the stopped sheet 410, thereby forming an image.

As described above, the liquid discharge apparatus 100 includes the liquid discharge head according to an embodiment of the present invention, thus allowing stable formation of high quality image.

Figure 14:
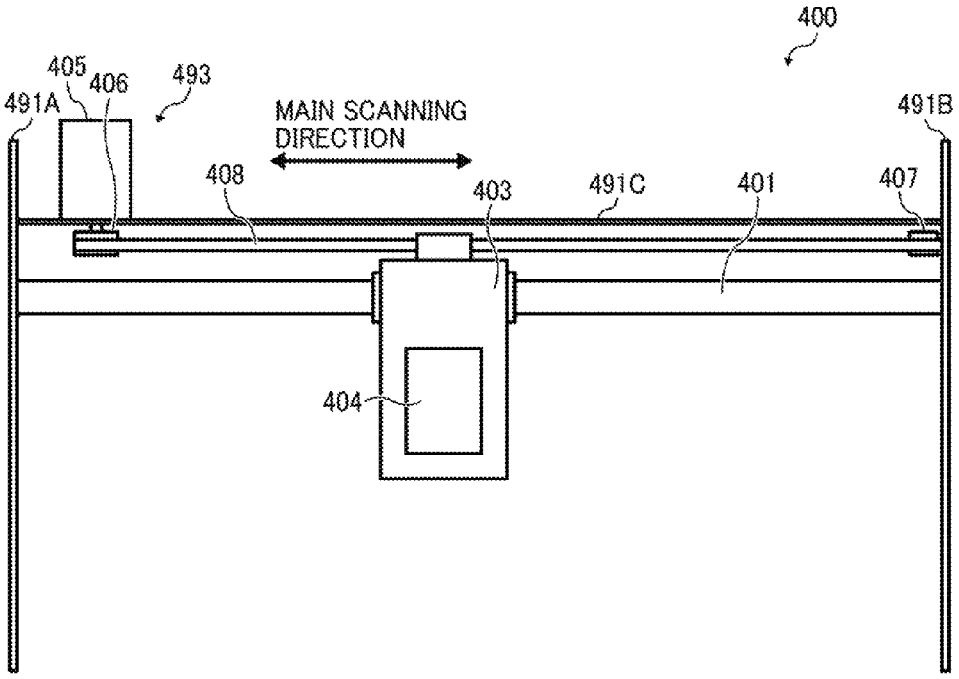
FIG. 14 is a plan view of a portion of a liquid discharge device according to an embodiment of the present invention.

Next, another example of the liquid discharge device according to the present: invention is described with reference to FIG. 14. FIG. 14 is a plan view of a portion of the liquid discharge device 400.

The liquid discharge device 400 includes the side plates 491A, 491B and the rear Plate 491C; the main scan moving unit 493; the carriage 403; and the liquid discharge head 404.

This liquid discharge device 400 further including at least one of the maintenance unit 420 disposed, for example, on the side plate 491B, and the supply unit 494, may also be configured as a liquid discharge device 400.

Figure 15:
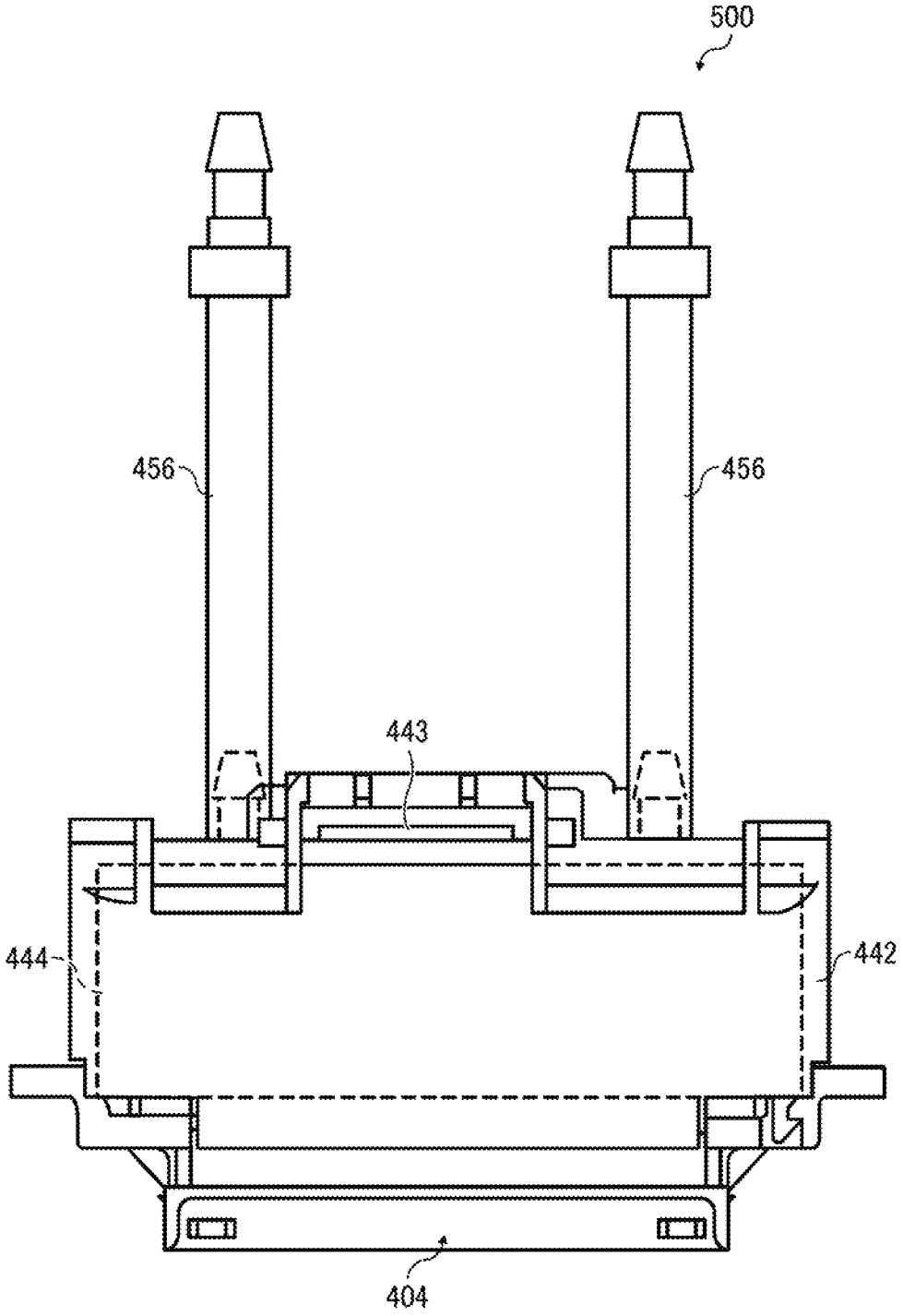
FIG. 15 is a front view of a liquid discharge device according to another embodiment of the present invention.

Next, another liquid discharge device according to the present embodiment is described with reference to FIG. 15. FIG. 15 is a front view of a portion of the liquid discharge device 500.

The present liquid discharge device 500 includes the liquid discharge head 404 to which a channel member 444 is attached, and the tube 456 connected to the channel member 444.

Further, the channel member 444 is disposed inside a cover 442. Instead of the channel member 444, the liquid discharge device 500 may include the head tank 441. A connector 443 disposed above the channel member 444 electrically connects the liquid discharge head 404 with a power source.

In the embodiments of the present invention, the liquid discharge apparatus includes a liquid discharge head or a liquid discharge device, and drives the liquid discharge head to discharge a liquid. As the liquid discharge apparatus, there are an apparatus capable of discharging a liquid to materials on which the liquid can be deposited as well as an apparatus to discharge the liquid toward a space or liquid.

The liquid discharge apparatus may include devices to feed, convey, and discharge the material on which the liquid can be deposited. The liquid discharge apparatus may further include a pretreatment apparatus to coat a treatment liquid onto the material, and a post treatment apparatus to coat the treatment liquid onto the material, onto which the liquid has been discharged.

Exemplary liquid discharge apparatuses may include, for example, an image forming apparatus to form an image on the sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize images with letters or figures having meaning. Alternatively, the liquid discharge apparatus forms images without meaning such as patterns and three-dimensional objects.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the liquid discharge head and a line-type apparatus not to move the liquid discharge head.

The exemplary liquid discharge apparatuses include otherwise a treatment liquid coating apparatus to discharge the treatment liquid to the sheet to coat the treatment liquid on the surface of the sheet for the purpose of reforming as sheet surface, and an injection granulation apparatus in which a composition liquid including raw materials dispersed in the solution is injected with the nozzle to granulate fine particles of the raw material.

The liquid discharge device is an integrated unit including the liquid discharge head and functional parts, or the liquid discharge head and other structures, and denotes an assembly of parts relative to the liquid discharge. For example, the liquid discharge device may be formed of a combination of the liquid discharge head with one of the head tank, carriage, supply unit, maintenance unit, and main scan moving unit.

Herein, examples of integrated unit include a liquid discharge head plus functional parts, of which structure is combined fixedly to each other through fastening, binding, and engaging, and ones movably held by the other parts. In addition, the liquid discharge head can be detachably attached to the functional parts or structures each other.

For example, an example of the liquid discharge device 440 as illustrated in FIG. 13 is integrally formed with the liquid discharge head and the head tank. Another example of the liquid discharge device is the integrally formed liquid discharge head and the head tank via the tube. A unit including a filter may further be added to a portion between the head tank and the liquid discharge head, thereby forming another liquid discharge device.

Further another example of the liquid discharge device is the liquid discharge head integrally formed with the cartridge.

Still another example of the liquid discharge device includes the liquid discharge head movably held by the guide member that forms part of the main scan moving unit, so that the liquid discharge head and the main scan moving unit are integrally formed. Further, as illustrated in FIG. 14, the liquid discharge head, the carriage, and the main scan moving unit are integrally formed, thereby forming the liquid discharge device 400.

Furthermore, a cap member that forms part of the maintenance unit is fixed to the carriage on which the liquid discharge head is mounted, so that the liquid discharge head, the carriage, and the maintenance unit are integrally formed, thereby forming the liquid discharge device.

Further, the liquid discharge device 500 as illustrated in FIG. 15 includes the tube that is connected to the head tank or the channel member to winch the liquid discharge head is attached, so that the liquid discharge head and the supply unit are integrally formed.

The main scan moving unit shall include a guide member itself. The supply unit shall include a tube itself, and a cartridge holder itself.

The pressure generating unit of the liquid discharge head is not limited in particular. For example, other than the piezoelectric actuator (or a layered-type piezoelectric element), a thermal actuator that employs thermoelectric conversion elements such as a thermal restrictor, and an electrostatic actuator formed of a vibration plate and an opposed electrode may be used.

The term "image formation" means not only recording, but also printing, image printing, molding, and the like.

Additional modifications and variations of the present invention are possible in light of the above teachings. It is therefore to be understood that, within the scope of the appended claims, embodiments of the invention may be practiced other than as specifically described herein.

What is claimed is:

1. A liquid discharge head comprising:

a plurality of nozzles to discharge a liquid;

a channel plate including a plurality of individual liquid chambers communicated with the plurality of nozzles;

a diaphragm member constituting a wall of the plurality of individual liquid chambers;

a supporting substrate disposed at a side opposite the channel plate, with the diaphragm member interposed between the supporting substrate and the channel plate;

a common liquid chamber forming substrate disposed at a side opposite the diaphragm member, with the supporting substrate interposed between the common liquid chamber forming substrate and the diaphragm member;

a common liquid chamber communicated with the plurality of individual liquid chambers;

a groove formed in an in-plane direction of a bonded face of the supporting substrate bonded to the diaphragm member; and a fluid restrictor disposed between the common liquid chamber and the plurality of individual liquid chambers, the fluid restrictor formed between the groove of the supporting substrate and a bonded face of the diaphragm member bonded to the supporting substrate.

2. The liquid discharge head according to claim 1, further comprising a plurality of grooves independent from each other in the bonded face of the supporting substrate bonded to the diaphragm member.

3. The liquid discharge head according to claim 2, further comprising a partition wall between adjacent grooves of the plurality of grooves independent from each other, wherein the partition wall is connected to another partition wall.

4. The liquid discharge head according to claim 1, further comprising:

a through-hole disposed in the supporting substrate and communicated with the common liquid chamber; and a damper portion of the diaphragm member disposed at a position corresponding to the through-hole, wherein the channel plate includes a damper chamber at a side opposite the through-hole of the supporting substrate with the damper portion interposed between the damper chamber and the through-hole of the supporting substrate.

5. The liquid discharge head according to claim 4, wherein the damper chamber is communicated with an external air.

6. The liquid discharge head according to claim 1, further comprising another fluid restrictor communicated with the common liquid chamber via the diaphragm member and the supporting substrate.

7. A liquid discharge device comprising the liquid discharge head according to claim 1.

8. The liquid discharge device according to claim 7, wherein the liquid discharge head is integrally formed with at least one of a head tank to store a liquid to be supplied to the liquid discharge head, a carriage to mount the liquid discharge head on the carriage, a supply unit to supply the liquid to the liquid discharge head, a maintenance unit to maintain the liquid discharge head, and a main scan moving unit to move the liquid discharge head in a main scanning direction.

9. A liquid discharge apparatus comprising the liquid discharge device according to claim 7.

10. A liquid discharge apparatus comprising the liquid discharge head according to claim 1.

11. The liquid discharge head according to claim 1, further comprising:

a piezoelectric element disposed on the bonded face of the diaphragm member at a side opposite a side at which the individual liquid chamber is disposed, wherein the supporting substrate includes a recessed portion to accommodate the piezoelectric element.

12. The liquid discharge head according to claim 1, wherein the diaphragm member includes an individual-chamber-side through-hole communicated with the individual liquid chamber, the supporting substrate includes a common-chamber-side through-hole opened to the common liquid chamber, and one end of the groove communicates with the individual-chamber-side through-hole of the diaphragm member, and another end of the groove communicates with the common-chamber-side through-hole of the supporting substrate.

* * * * *